US005151159A

United States Patent [19]

Wolfe et al.

[11] Patent Number: 5,151,159

[45] Date of Patent: Sep. 29, 1992

[54] METHOD AND APPARATUS FOR CONVERTING COAL INTO LIQUID FUEL AND METALLURGICAL COKE

[75] Inventors: Richard A. Wolfe; Chang J. Im, both of Abingdon, Va.; Robert E. Wright, Bristol, Tenn.

[73] Assignee: Coal Technology Corporation, Bristol, Va.

[21] Appl. No.: 614,085

[22] Filed: Nov. 15, 1990

[51] Int. Cl.[5] ..... C10B 7/02; C10B 7/10

[52] U.S. Cl. ..... 202/118; 202/241; 201/8

[58] Field of Search ..... 208/426; 201/5, 7, 44, 201/8; 202/84, 118, 241, 265

[56] References Cited

U.S. PATENT DOCUMENTS

| | | | |
|---|---|---|---|
| 1,468,379 | 9/1923 | Easton | 202/118 |
| 2,357,621 | 9/1944 | Tuttle | 202/118 |
| 2,998,375 | 8/1961 | Peterson et al. | 201/7 |
| 3,051,629 | 8/1962 | Garin et al. | 201/5 |
| 3,178,361 | 4/1965 | Bailey | 202/118 |
| 3,184,293 | 5/1965 | Work et al. | 201/5 |
| 3,251,751 | 5/1966 | Lindahl et al. | 201/12 |
| 4,094,746 | 6/1978 | Masciantonio et al. | 201/12 |
| 4,395,309 | 7/1983 | Esztergar | 201/26 |

FOREIGN PATENT DOCUMENTS

| | | | |
|---|---|---|---|
| 709336 | 5/1965 | Canada | 201/5 |

OTHER PUBLICATIONS

Perry et al, *Chemical Engineers' Handbook,* McGraw-Hill N.Y., N.Y., 1973 pp. 20-16-20-20, 20-4-2-20-44.

*Primary Examiner*—Theodore Morris
*Assistant Examiner*—David M. Brunsman
*Attorney, Agent, or Firm*—Jennings, Carter, Thompson & Veal

[57] ABSTRACT

Apparatus and method for converting coal into useful motor fuels and metallurgical coke using a self-cleaning coal pyrolyzer wherein coal is heated in the absence of air at temperatures greater than 800° F. to remove volatile hydrocarbon gases therefrom. Char remaining after such pyrolyzation is cooled and pulverized and mixed with selected binders at temperatures ranging from 125° to 200° F. to form briquettes. The briquettes are calcined at temperatures ranging from 1800° to 2000° F. to form metallurgical coke. The gaseous hydrocarbons are separated into liquid coal fuels, non-condensable gases and water vapor. The liquid coal fuels are further separated into various motor fuels while the non-condensable gases are used to fuel the coal pyrolyzer.

15 Claims, 4 Drawing Sheets

METHOD AND APPARATUS FOR CONVERTING COAL INTO LIQUID FUEL AND METALLURGICAL COKE

FIELD OF THE INVENTION

The present invention relates to coal processing methods and apparatus. In greater particularity the present invention relates to apparatus and methods for converting coal into motor usable fuels and metallurgical coke. In even greater particularity the present invention relates to coal retorts, mixers, crushers and briquetting apparatus in specific combination.

BACKGROUND OF THE INVENTION

Coal heated to selected temperatures in the absence of air yields coal gas, coal liquids and a residue char. Yield of the three products will vary with the temperature at which the coal is heated and the duration of time such heating is conducted. Typically such a process is facilitated by repetitively introducing batches of coal into a retort wherein the coal is heated for a period of up to 18 hours. Volatile hydrocarbon gases are released from the heated coal and are condensed into coal liquids. The remaining char is mixed with various binders and calcined to form coke for use in a blast furnace.

The batch process is usable, however, under the current economic environment, is not efficient enough to produce a satisfactory amount of coke or coal fuel to economically justify its practical application as an alternative fuel producing mechanism.

In response to this economic dilemma, various apparatus for continuously conveying coal through a retort have been devised. Conveyors and screw mechanisms are the most common. The most visible problem with these conveying apparatus is that coal assumes a plastic consistency during the pyrolyzation stage and clings to the conveyor or screw to form a residue layer that reduces the rate of conveyance of coal through the retort and eventually impairs the efficient distribution of heat through the coal being conveyed therethrough. The plasticity of heated coal also creates technical problems that hinder the continuous conversion of the char produced in the retort into an industrial metallurgical coke.

U.S. Pat. No. 1,481,627 issued to Smith discloses a method for treating coal and manufacturing briquettes wherein briquettes are calcined at approximately 1850° F. Pitch is added to char to bind the briquette and to raise the percentage of volatile hydrocarbons comprised therein.

U.S Pat. No. 3,178,361 issued to Bailey discloses apparatus having a plurality of screws for facilitating the continuous carbonization of coal. The coal is heated at temperatures ranging from 500° to 600° F.

U.S. Pat. No. 3,251,751 issued to Lindahl et al. discloses a process for carbonizing coal using screws for conveying the coal through a retort.

U.S. Pat. No. 3,401,089 issued to Friedrich et al. discloses a process for making form coke by agglomerating discrete carbonaceous particles in a tumbling zone of a rotating retort including carbonaceous particles previously subjected to agglomeration in said tumbling zone. The process includes the steps of introducing finely divided caking bituminous coal, pitch binder and solid distillation residue of coal into the tumbling zone and calcining the mixture to form coke.

U.S. Pat. No. 3,403,989 issued to Blake et al. discloses a process for producing briquettes from calcined char, wherein the briquettes comprise 75% to 90% char.

U.S. Pat. No. 4,094,746 issued to Masciantonio et al. discloses a coal conversion process using liquefaction techniques and gas separation of coal liquids liberated by such liquefaction processing.

Exemplary of current coal conversion processes and apparatus is U.S. Pat. No. 4,395,309 issued to Esztergar. Esztergar teaches means for conveying coal over a screen encased within a retort. Heating elements above the screen pyrolyze coal causing volatile hydrocarbon to escape the retort for separation into various grades of oil.

It is very important that a chosen pyrolyzation and coke forming process produce coke that has a coke reactivity index (CRI) less than 30 and a coke strength after reaction (CRS) greater than 55. Though no official standard has been recognized to indicate at what grades coke is satisfactory for use in a blast furnace, it is recognized that coke having the aforementioned CRI and CSR ratings is high grade coke that is more than adequate for use in blast furnace operation.

CRI is determined by reacting 200 grams of $\frac{3}{4}'' \times \frac{7}{8}''$ dry coke with carbon dioxide adjusted to a flow rate of 5 liters/minute for two hours at 1100° C. (2012° F.). CRI is reported as the percent weight loss of the coke sample after this reaction.

CSR is determined by tumbling the coke used during the CRI test in a drum for 600 revolutions at 20 RPMs. The cumulative percent of plus $\frac{3}{8}''$ coke after tumbling is reported as the CSR.

Variations in carbonization and calcining temperatures, residency time, briquetting pressures and the selection of binding materials mixed with the char to form coke all effect the resultant CRI and CSR of the resultant coke. Closely controlled manipulation of the coal throughout the entire procedure is a necessity for producing a high grade coke having minimal CRI and maximum CSR levels.

SUMMARY OF THE INVENTION

It is the principal object of the present invention to provide apparatus and process for continuously converting coal into motor usable liquid fuels and high grade metallurgical coke.

In support of the principal object another object of the present invention is to minimize the negative effects of the plastic nature of pyrolyzed coal on the aforementioned apparatus and process.

Yet another object of the present invention is to maximize the rate at which such motor fuels and metallurgical coke are produced Still another object of the present invention is to provide a metallurgical coke having a minimal coal reactivity index and a maximum coke strength after reactivity.

These and other objects and advantages of the present invention are accomplished by introducing a stream of coal into a coal crusher, wherein the coal is reduced to a particle size approximately $\frac{1}{4}'' \times O$ or $\frac{1}{8}'' \times O$. The coal particles are then conveyed through an airlock to a pyrolyzer unit into which the coal particles are fed at a selected rate. The coal pyrolyzer includes a retort chamber having a pair of interfolded screw conveyors rotatably connected therein to convey coal therethrough at the selected rate. The screws rotate in opposite directions with such rotation being intermittently reversed to prolong the residence time of the coal within the retort chamber.

The temperature within the retort chamber is maintained at 800° F. or more by a gas furnace encasing the retort chamber and electrical heating elements received within each screw's drive shaft. The residence time of the coal in the coal pyrolyzer is approximately twenty minutes. Heating the coal to such high temperatures softens the coal to a plastic consistency and results in the collection of coal residue on the drive screws. A lost motion clutch is connected to one of the screws to periodically bring the screw's spiral flights in contact to scrape away any coal residue adhering thereto. Apertures in the top of the retort chamber serve as vents through which volatile hydrocarbon gases, released from the pyrolyzed coal, may escape.

Alternatively, a predrying retort, similar in design to the coal pyrolyzer, is provided through which the coal is conveyed and heated at temperatures below 400° F. prior to entry within the coal pyrolyzer. A single screw is utilized in the predryer to convey the coal therethrough as coal does not assume a plastic nature at such low temperatures.

Thermocouples are located at the discharge end of the predryer, at the mid-point of the coal pyrolyzer, at the discharge end of the pyrolyzer, proximal the electric heating elements, in the furnace and proximal the connection of the screws with the retort chamber. These thermocouples sense heat and correspondingly adjust the temperature of the furnace to regulate the temperature within the retort chamber and the predryer.

Gases released from the coal being conveyed through the predryer and the retort are piped to a condenser wherein the gases are separated into condensable coal liquids, water vapor and non-condensable gases. The water vapor and non-condensable gases are conducted through a scrubber wherein the water vapor is separated from the non-condensable gases which are used for fuel in the furnace. The condensable coal liquids are introduced into a separation unit wherein the condensable coal liquids are separated into volatile hydrocarbon motor fuels and motor fuel supplements.

The solid portion of the coal remaining after the volatile hydrocarbon gases and water vapor have been removed is referred to as char. The char is discharged from the coal pyrolyzer and introduced into a char cooler whose sole function is to cool the char below a temperature at which the char will ignite when exposed to air. The cooled char is conveyed to a char delumper which pulverizes the cooled char for easier handling. The char particles are conveyed through a second airlock which in combination with the first airlock isolates the predryer, the coal pyrolyzer, the char cooler and the char delumper from the atmosphere and more specifically the oxygen transported therein. After passing the second airlock, the char is conveyed to a char mixer wherein the char is combined with selected binder materials. The mixture of char and binders is conveyed to a briquette machine which forms the char and binders into briquettes. The briquettes are introduced into a coking oven wherein the briquettes are calcined at temperatures ranging from 1800° F.–2000° F. to form metallurgical coke. The coke briquettes are subsequently cooled to a temperature low enough so they will not ignite when exposed to air and are thereafter ready for use in a blast furnace.

BRIEF DESCRIPTION OF THE DRAWINGS

Apparatus embodying features of our invention are depicted in the accompanying drawings which form a portion of this disclosure and wherein.

DESCRIPTION OF A PREFERRED EMBODIMENT

Figure 1A:
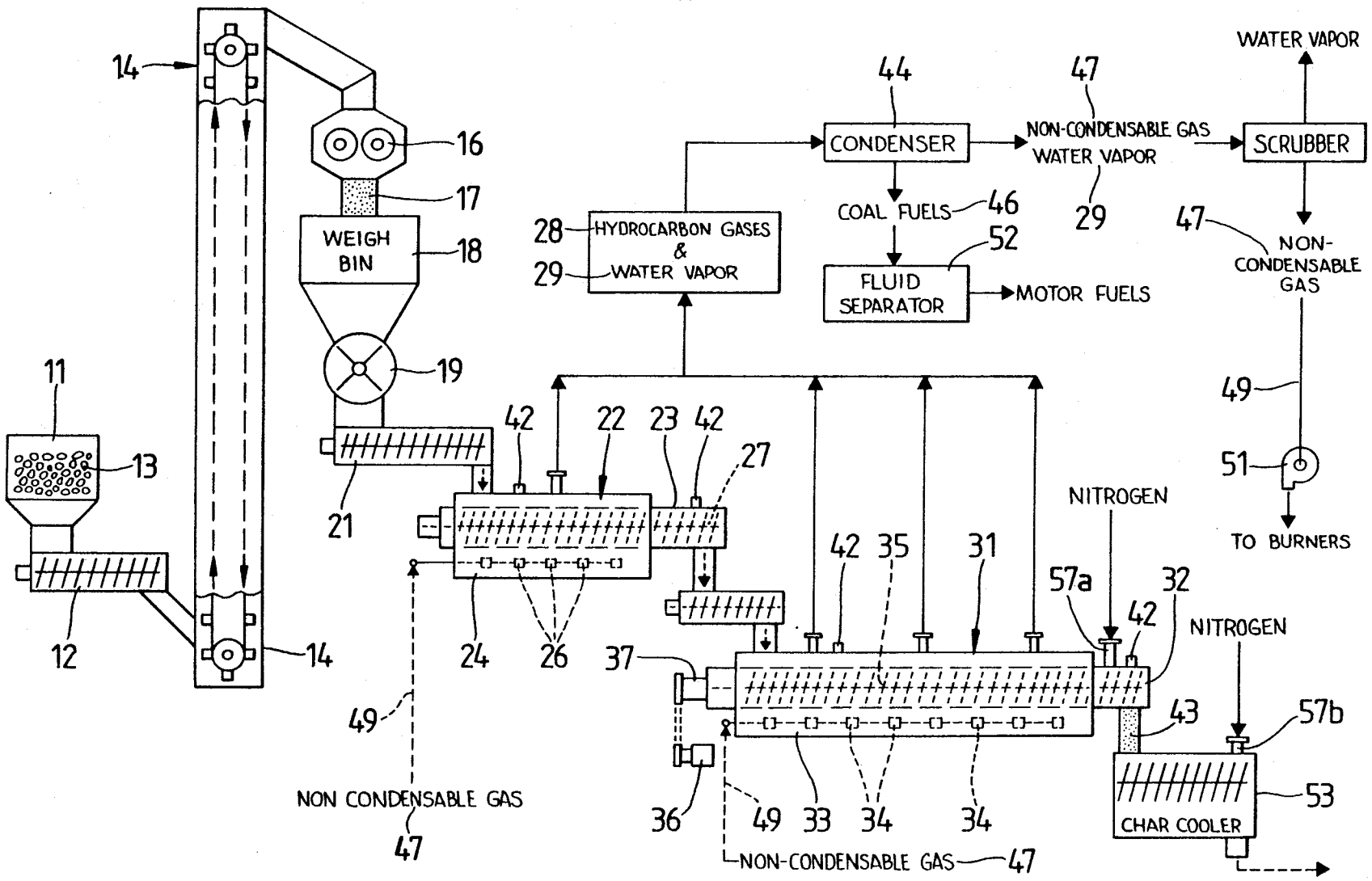
FIG. 1A and 1B in combination are schematic views of the present invention.

Referring to the drawings for a clearer understanding of the invention, it should be noted in FIG. 1A that the present invention contemplates the use of a coal receiving hopper 11 and a first feed screw conveyor 12 connected to the coal receiving hopper 11 for conveying coal 13 deposited therein to a bucket elevator 14. The coal 13 is conveyed to a higher elevation by the bucket elevator 14 and discharged into a coal crushing unit 16 connected thereto. The coal 13 is reduced to coal particles 17 of predetermined size, preferably $\frac{1}{4}''\times O$ or $\frac{1}{8}''\times O$ by the crusher 16 and is subsequently introduced into a first weighing bin 18 wherein the unit weight of the coal particles 17 is measured. The coal particles 17 fall from the first weighing bin 18 through a first airlock 19 connected thereto. A second feed screw conveyor 21, connected to the first airlock 19, receives the coal particles 17 therefrom and conveys the coal particles 17 to a predryer 22 connected to the second feed screw conveyor 21.

The predryer 22 includes a drying chamber 23 encased within a drying furnace 24 having a plurality of burners 26 mounted therein. The drying chamber 23 has a drive screw 27 rotatably mounted therein and driven in a selected angular direction for conveying the coal particles 17 through the drying chamber 23 at a predetermined rate. The temperature in the drying chamber 23 is maintained equal to or less than 400° F. to release a portion of the volatile hydrocarbon gases 28 and water vapor 29 typically incorporated within the coal particles 17. A coal pyrolyzer 31 is hermetically connected to the predryer 22 and receives the coal particles 17 discharged therefrom.

Figure 2:
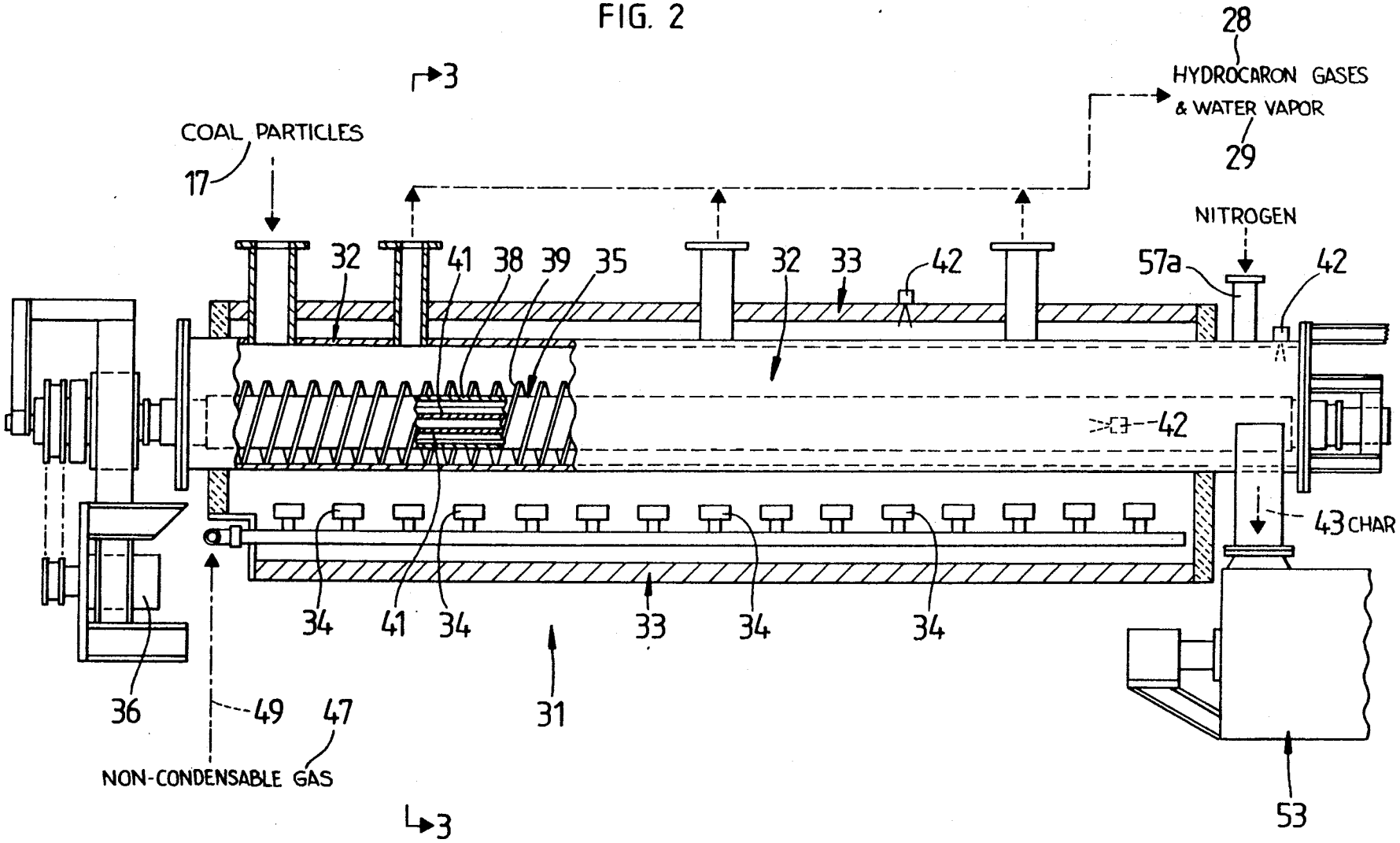
FIG. 2 is a sectional side elevational view of a coal pyrolyzer.
Figure 4:
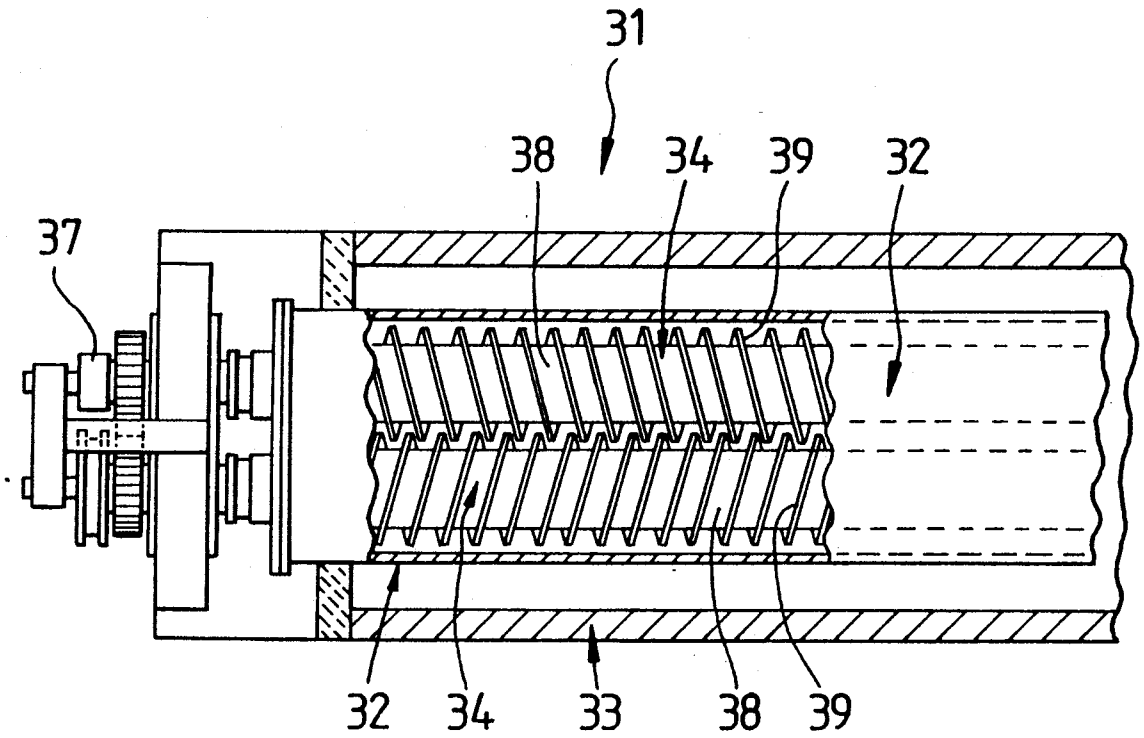
FIG. 4 is a broken away plan view of a coal pyrolyzer.
Figure 3:
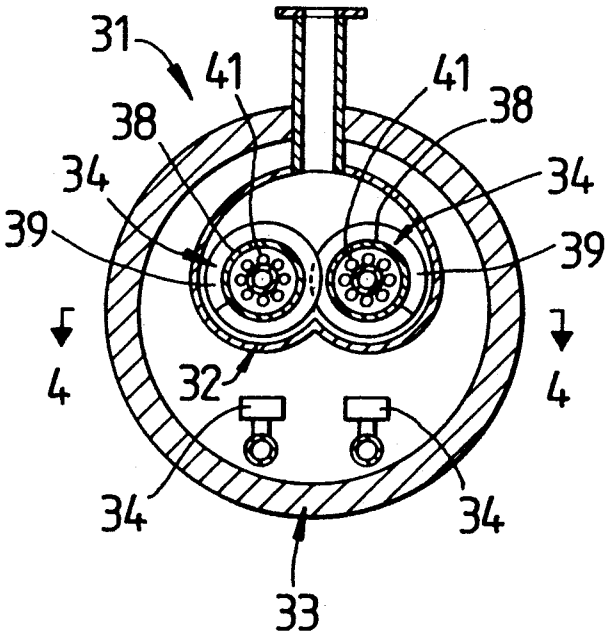
FIG. 3 is sectional view taken along line 3—3 of FIG. 2.

As shown in FIGS. 2–4, the coal pyrolyzer 31 includes a retort chamber 32 hermetically connected to and in communication with the predryer 22 and encased within a pyrolyzing furnace 33 having burners 34 mounted therein for producing a gas fueled flame. A pair of parallel interfolded drive screws 35 are rotatably mounted within the retort chamber 32 for conveying the coal particles 17 therethrough. A motor 36 is connected to the drive screws 35 for rotating the same. At predetermined intervals, the motor reverses the rotation of the drive screws 35 to prolong the residence time during which the coal particles 17 remain in the retort chamber 32. As shown in FIG. 4, a lost motion clutch 37 is connected to a predetermined one of the pair of drive screws 35 to temporarily reduce the angular velocity of the predetermined drive screw concurrent with each reversal of the rotation thereof.

Each drive screw 35 includes a tubular drive shaft 38 on which a flight 39 is connected in spiraling relation thereto. The flights 39 are interfolded, thus the reduction in rotational speed of the predetermined drive screw 35 causes the interfolded flights 39 to temporarily contact an dislodge coal residue collected thereon. As shown in FIGS. 2 and 3, a plurality of heating elements 41 are received within each drive shaft 39 to supplement the pyrolyzing furnace 33 in heating the shaft 39, the flights 38 and the coal particles 17. The additional heat supplied by the heating elements 41 to the shaft 39 and the flights 38 prevents the coal particles 17 from being cooled by contact with the drive screws 35, thereby preventing adherence of the coal particles thereto. As shown in FIGS. 1*a* and 2, thermocouples 42 are connected to the drying chamber 23, the retort chamber 32, the drive screws 35, the drying furnace 24 and the pyrolyzing furnace 33 to monitor temperature and to automatically regulate the drying furnace 24, the pyrolyzing furnace 33 and the electric elements 41 to maintain the temperatures generated thereby at selected levels.

The retort chamber 32 is heated to 800° F. or higher to pyrolyze the coal particles 17 passing therethrough and to release the remaining volatile hydrocarbon gases 28 and water vapor 29 incorporated within the coal particles. Devolatilized coal residue or char 43 is discharged from the retort chamber 32 by the drive screws 35.

As shown in FIG. 1A, a condenser 44 is connected to and in communication with the retort chamber 32 and the drying chamber 23 to receive the hydrocarbon gas 28 and water vapor 29. The condenser 44 separates the volatile hydrocarbon gases 28 into coal fuels 46 and non-condensable gases 47 using methods and apparatus commonly known in the industry.

A scrubber unit 48 is connected to and in communication with the condenser 44 to receive and separate the non-condensable gas 47 from the remaining water vapor 29. A plurality of tubular conduits 49 and a gas pump 51 are operatively connected intermediate to and in communication with the scrubber unit 48 and the drying and pyrolyzing furnaces 23 and 33 for conveying the non-condensable gases 47 from the scrubber 48 to the burners 26 for use as a fuel.

A fluid separator unit 52 is connected to and in communication with the condenser 44 for receiving the coal fuels 46 therefrom and converting the coal fuels 46 into selected motor fuels.

Figure 1B:
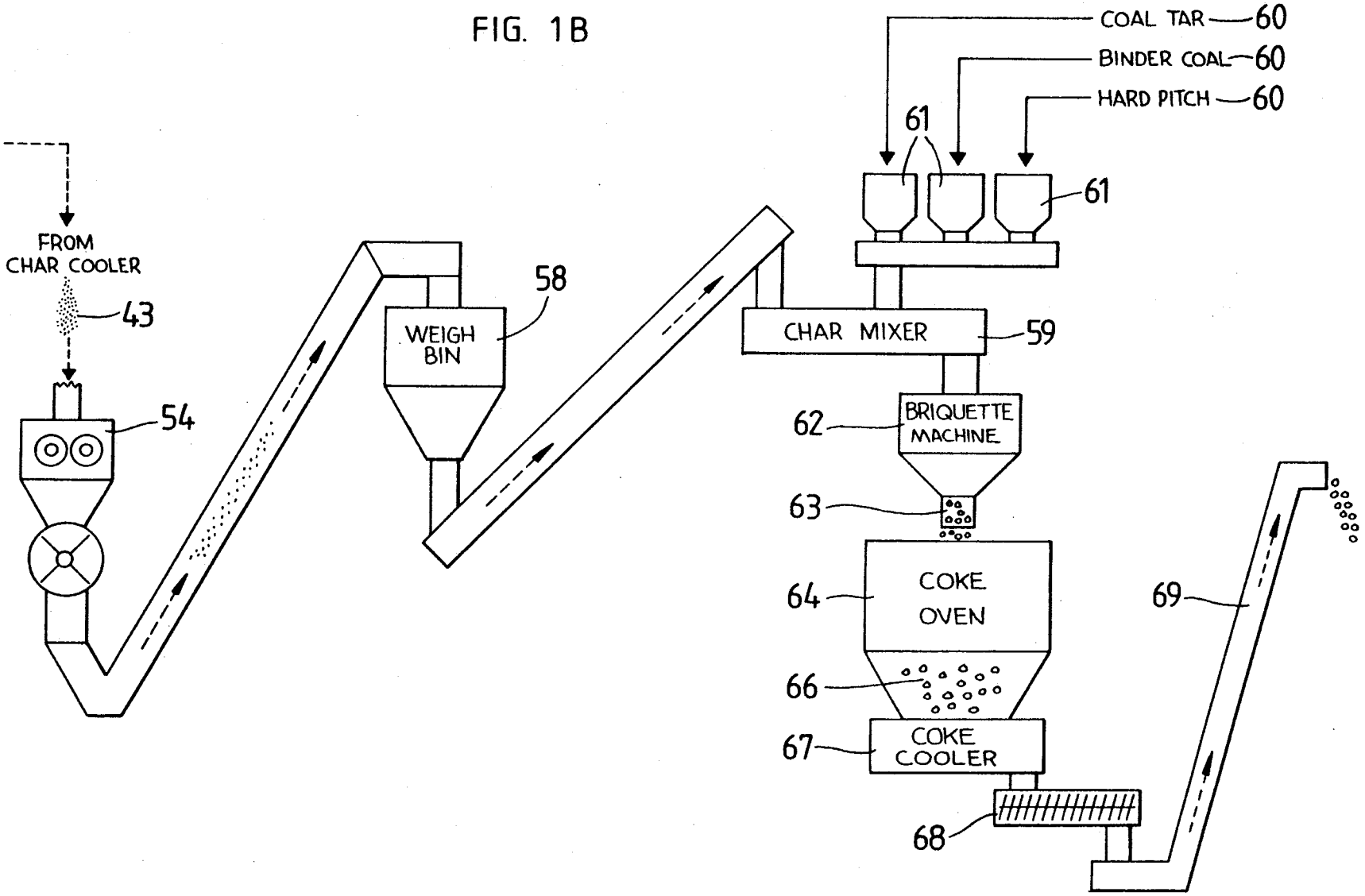

Char 43 discharged from the coal pyrolyzer 31 is received within a char cooler 53 hermetically connected to the coal pyrolyzer 31. The char cooler 53 cools the char 43 to a brittle consistency and to a temperature below that which the char would ignite if exposed to air. As shown in FIGS. 1A and 1B, a char delumper 54 is hermetically connected to the char cooler 53 and receives the char 43 therefrom to pulverize the char 43 to a powdered consistency. As shown in FIG. IB pulverized char 43, discharged from the delumper 54, passes through a second airlock 56 hermetically connected to the delumper 54. The second airlock 56 in combination with the first airlock 19 isolates atmospheric gases from the pyrolyzer, the char cooler and the pulverizer, thereby preventing the combustion of the coal particles 17. Nitrogen gas is piped through portals 57*a* and 57*b* into the pyrolyzer 22 and the char cooler 53, respectively, to assure that the predryer, pyrolyzer and char cooler are free of atmospheric air.

Pulverized char 43 discharged from the second airlock 56 is conveyed to a second weighing bin 58 for determining the unit weight of the char 43. After weighing, the char 43 is conveyed to a char mixer 59 which mixes the char 43 with selected binders 60. A plurality of binder receiving hoppers 61 are connected to the char mixer 58 for receiving selected binders 60. The binders 60 preferred for use with the present invention include binder coal, coal tar and hard pitch, however those skilled in the art will recognize that other binders can be used with the present apparatus. The char 43 and selected binders are mixed at temperatures ranging from 125° F. to 200° F. Extensive experimentation has shown that the preferred mixtures of char 43 and selected binders are; char, binder coal, hard pitch and coal tar at mixing ratios ranging from about 65–69%, 25–27%, 0–10%, 0–5.5%, respectively. The exact ratios of the coke components will depend on the residence time and temperature in the pyrolyzer, the specific coal being pyrolyzed and the specific binder coal being used.

After mixing, the char 43 and binders 60 are introduced into a briquette machine 62 which compresses the binders 60 and char 43 into briquettes 63 The briquettes 63 are introduced into a coke oven 64 which heats the briquettes 63 at temperatures ranging from 1800° F. to 2000° F., thereby calcining the briquettes into high grade metallurgical coke 66. A coke cooler 67 is connected to the coke oven 64 to receive and cool the coke 66 to a temperature at which the coke 66 can be easily handled and to a temperature at which the coke 66 will not ignite when exposed to air. A third feed screw conveyor 68 is connected to the coke cooler 67 to receive the coke 66 discharged therefrom and convey the coke 66 to a loading conveyor 69.

It should be clear that the present apparatus and method represent an improved method of producing motor fuels and metallurgical coke. The present apparatus processes coal at a coal feed rate of 1000 lbs per hour and by applying suitable scale-up factors can be built with a coal feed rate of up to 1,000,000 tons/year. The present apparatus produces metallurgical coke having a CRI of less than 30 and CSR of more than 55 which is well within the industry standard for high grade coke utilized in blast furnace operations. The present apparatus minimizes the effect of coal plasticity on the efficiency of coke and liquid fuel production and, based on the foregoing, represents a substantial improvement over the prior art.

While I have shown the invention in one form, it will be obvious to those skilled in the art that it is not so limited but is susceptible of various changes and modifications without departing from the spirit thereof.

What I claim is:

1. An apparatus for continuously processing coal into gaseous and liquid volatile hydrocarbons and into metallurigical coke suitable for use in a steel industry blast furnace, comprising:

(a) means for crushing said cola into coal particles:

(b) a coal pyrolyzer located subjacent said crushing means for receiving and heating said coal particles to temperatures greater than 800° F., whereby said coal particles are converted to char and volatile hydrocarbon gas, wherein said coal pyrolyzer includes:

(i) a retort chamber externally heated by a gas furnace connected thereto;

(ii) a pair of parallel interfolded drive screws rotatably connected to and encompassed within said retort chamber for conveying said coal particles therethrough;

(iii) means connected to said drive screws for rotating said drive screws, wherein said rotating means intermittently reverses the rotation of said drive screws to prolong the residency of the coal particles conveyed thereby within said retort chamber; and (iv) a lost motion clutch connected to one of said drive screws and said rotating means for temporarily reducing the angular rotation speed of said one of said pair of drive screws, wherein said drive screws contact concurrently with said reduction in the angular rotational speed of said one of said drive screws to disengage any said coal or char adhering thereto;

(c) means connected to said pyrolyzer for separating said volatile hydrocarbons gas into water vapor, condensable hydrocarbon liquids and non-condensable gases, wherein said gas furnace is connected to said separating means and receives non-condensable gases therefrom for use as a fuel;

(d) means connected to said pyrolyzer for cooling said char to prevent the ignition thereof when exposed to air;

(e) means connected to said cooling means for pulverizing said char;

(f) means connected to said pulverizing means for mixing selected binders with said char;

(g) means connected to said mixing means for compressing said char and said selected binders into briquettes;

(h) means connected to said compressing means for heating said briquettes to temperatures ranging from 1800° F. to 2000° F., thereby calcining said briquettes into metallurgical coke; and (i) means connected to said heating means for cooling said coke to prevent the ignition thereof when exposed to air.

2. Apparatus as described in claim 1 further comprising electric heating elements connected- to said drive screws for heating said drive screws and said coal conveyed thereby.

3. Apparatus as described in claim 2 wherein each said drive screw comprises a tubular drive shaft in which at least one of said heating elements is received.

4. Apparatus as described in claim 1 wherein said drive screws comprise interfolded spiral flights that recurrently contact subsequent to said reversing of said drive screws.

5. Apparatus as described in claim 1 wherein said separating means comprises:

(a) a condenser connected to said retort chamber for separating said volatile hydrocarbon gas into said condensable hydrocarbon liquids and said non-condensable gases;

(b) a scrubber unit connected to said condenser for extracting water vapor from said non-condensable gases; and (c) a fluid separator connected to said condenser for converting said condensable hydrocarbon liquids into selected motor fuels.

6. Apparatus as described in claim 1 further comprising means connected intermediate said crushing means and said pyrolyzer for predrying said coal particles at temperatures less than 400° F. prior to introduction of said coal particles within said coal pyrolyzer, wherein said predrying means removes a portion of said volatile hydrocarbon gases from said coal particles.

7. Apparatus as described in claim 1 further comprising means connected intermediate said crushing means and said pyrolyzer and intermediate said pulverizing means and said mixing means for isolating atmospheric gases from said pyrolyzer, said char cooling means and said pulverizing means.

8. Apparatus as described in claim 1 wherein said isolating means comprises: (a1) a first airlock connected intermediate to and in selected communication with said crushing means and said pyrolyzer; and (b) a second airlock connected intermediate to and in selected communication with said pulverizing means and said mixing means, wherein said first and second airlocks, respectively, permit the flow of coal particles and char therethrough but prevent the passage of atmospheric gases to said pyrolyzer, said char coaling means and said pulverizing means.

9. Apparatus as described in claim 1 further comprising means connected to said retort chamber, said gas furnace and said drive screws for regulating the temperature within said retort chamber.

10. An apparatus for continuously processing coal into selected gaseous and liquid volatile hydrocarbons and into metallurgical coke suitable for use in a steel industry blast furnace, comprising a coal pyrolyzer for heating said coal to temperatures greater than 800° F. thereby converting said coal to char and volatile hydrocarbon gas and having a retort chamber externally heated by a gas furnace connected thereto, a pair of parallel interfolding and internally heated drive screws rotatably connected to and encompassed within said retort chamber for conveying said coal therethrough, means connected to said drive screws for rotating said drive screws and intermittently reversing the rotation thereof to prolong the residency of the coal conveyed thereby within said retort chamber, and a lost motion clutch connected to a predetermined one of said drive screws and said rotating means for temporarily reducing the angular rotational speed of said predetermined one of said drive screws, wherein said drive screws contact concurrently with the reduction in angular rotational speed of said predetermined one of said drive screws to disengage any said coal or char adhering thereto.

11. Apparatus as described in claim 10 further comprising:

(a) means operatively connected to said coal pyrolyzer for mixing selected binders with said char;

(b) means connected to said mixing means for compressing said char and said selected binders into briquettes; and (c) means connected to said compressing means for heating said briquettes to temperatures ranging from 1800° F. to 2000° F., thereby calcining said briquettes into metallurgical coke.

12. Apparatus as described in claim 10 further comprising heating elements connected to said drive screws for heating said drive screws and said coal conveyed thereby.

13. Apparatus as described in claim 12 wherein each said drive screw comprises a tubular drive shaft in which said heating elements are received.

14. Apparatus as described in claim 10 wherein said drive screws comprise interfolded spiral flights that recurrently contact subsequent to said reversing of said drive screws.

15. Apparatus as described in claim 10 further comprising means connected to said coal pyrolyzer for predrying said coal particles at temperatures less than 400° F. prior to the introduction of said coal within said coal pyrolyzer, wherein said predryer removes a portion of said volatile hydrocarbon gases from said coal.

* * * * *